United States Patent [19]

Stedman

[11] 3,941,195

[45] Mar. 2, 1976

[54] BULLDOZER WITH HORIZONTAL BRACE

[75] Inventor: Robert N. Stedman, Chillicothe, Ill.

[73] Assignee: Caterpillar Tractor Co., Peoria, Ill.

[22] Filed: Sept. 1, 1971

[21] Appl. No.: 176,916

Related U.S. Application Data

[63] Continuation-in-part of Ser. No. 727,548, May 8, 1968, abandoned.

[52] U.S. Cl. ..... 172/801; 172/809

[51] Int. Cl.[2] ..... E02F 3/76

[58] Field of Search ..... 172/801, 802, 803, 804, 172/805, 806, 807, 808, 809, 277

[56] References Cited

UNITED STATES PATENTS

| | | | |
|---|---|---|---|
| 1,442,796 | 1/1923 | Detwiler | 172/277 X |
| 1,497,630 | 6/1924 | Beatty et al. | 172/277 X |
| 1,915,355 | 6/1933 | Court et al. | 172/277 |
| 2,225,393 | 12/1940 | Ray | 172/277 X |
| 2,868,579 | 1/1959 | Panasewicz | 172/801 X |
| 2,869,256 | 1/1959 | Pereira | 172/803 |
| 3,025,620 | 3/1962 | Liess | 172/803 |
| 3,049,820 | 8/1962 | Lichti | 172/803 |
| 3,395,764 | 8/1968 | Wirt | 172/803 |

FOREIGN PATENTS OR APPLICATIONS

| | | | |
|---|---|---|---|
| 258,403 | 1/1964 | Australia | 172/801 |

*Primary Examiner*—E. H. Eickholt
*Attorney, Agent, or Firm*—Phillips, Moore, Weissenberger Lempio & Strabala

[57] ABSTRACT

A bulldozer having a brace between the blade and the frame of the tractor upon which the blade is mounted to absorb lateral forces encountered by the blade and to make unnecessary the conventional diagonal braces thus enabling the blade to be mounted closer to the front end of the tractor.

4 Claims, 5 Drawing Figures

INVENTOR
ROBERT N. STEDMAN

BY
Fryer, Tjensvold, Feix, Phillips & Lempio
ATTORNEYS

INVENTOR
ROBERT N. STEDMAN

BY
Fryer, Tjensvold, Feix, Phillips + Lempio
ATTORNEYS

INVENTOR
ROBERT N. STEDMAN

BY
Fryer, Ziemold, Feit, Phillips & Lunsford
ATTORNEYS

BULLDOZER WITH HORIZONTAL BRACE

CROSS-REFERENCE TO RELATED APPLICATION

This application is a Continuation-in-Part of abandoned U.S. application Ser. No. 727,548, filed May 8, 1968.

BACKGROUND OF THE INVENTION

It is conventional practice, particularly on large bulldozer blades, to provide diagonal braces extending angularly between the push arms and the back of the blade. With very large bulldozer blades, it is desirable to mount the blade as close as possible to the forward end of the tractor. Ordinary diagonal braces prevent the blade from being mounted as close to the tractor as desired because they would interfere with the forward ends of the tracks.

SUMMARY OF THE INVENTION

It is an object of the present invention to provide a single link or bracing means interconnected between a bulldozer and the frame of a tractor to absorb transverse forces, such as those encountered when an end of the bulldozer blade encounters a stationary object. A further object is to locate such bracing means so that it occupies very little space between the forward end of the tractor and the blade, does not interfere with ordinary blade adjustments and permits the blade to be mounted close to the forward end of the tractor to improve machine stability and maneuverability.

The manner in which the foregoing objects are carried into practice is made apparent in the following specification wherein reference is made to the accompanying drawings.

DETAILED DESCRIPTION

Figure 1:
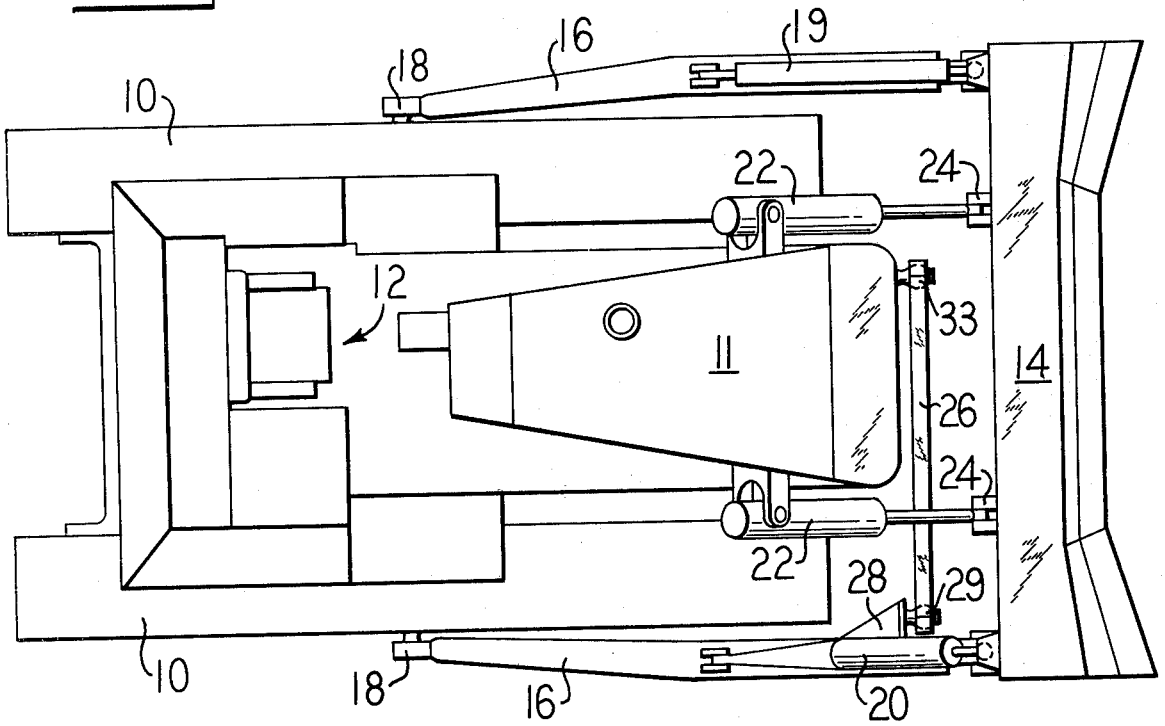
FIG. 1 is a plan view of a tractor and bulldozer combination with bracing means extending between one push arm and the tractor to resist sidewise or lateral forces to which the blade is subjected.

The tractor shown in FIG. 1 comprises tracks 10, an engine compartment 11 and an operator's station generally indicated at 12. A transverse bulldozer blade 14 of a bulldozer, positioned closely adjacent to a forward end of the tractor, is carried at the forward ends of laterally spaced push arms 16 which are independently pivoted by universal joints 18 to conventional track roller frames (not shown) at first and second sides of the tractor. The blade is pivotally connected directly to the forward ends of the push arms and is normally held in an erect position by braces 19 and 20, connected between the push arms and the back of the blade at a point above the connections of the push arms to the blade. Brace 20 includes an actuator or tilt means which may be hydraulically actuated for imparting tilt to the blade. The blade is raised and lowered by conventional hydraulic actuators 22, supported on opposite sides of the engine housing and having rods pivotally connected at 24 to the back of the blade.

The present invention utilizes a single link or bracing means 26 preferably universally interconnected between the tractor and bulldozer to avoid the necessity for multiple braces extending angularly between the push arms 16 and the back of the blade, such as the braces disclosed in U.S. Pat. No. 3,049,820, assigned to the assignee of this application. The single rigid link is entirely located between the forward end of the tractor and the blade and extends transversely of the tractor in substantial parallel relationship with the blade. The first end of the link is pivotally connected to a bracket 28 on one push arm, by a ball and socket joint 29, and the second end is pivoted to a bracket 30 depending from main tractor frame members 32 by a ball and socket joint 33.

Since connection 29 on one push arm is located at a lateral end of the bulldozer on the first side of the tractor which is remote from connection 33, disposed on the second side of the tractor, the arcuate travel of the link at joint 29 is very small. Thus, raising and lowering of the blade by actuators 22 imparts only an imperceptible motion thereto. With this construction, link 26 acts as a rigid brace between the main frame and the bulldozer blade which prevents an appreciable sidewise motion of the blade.

Figure 3:
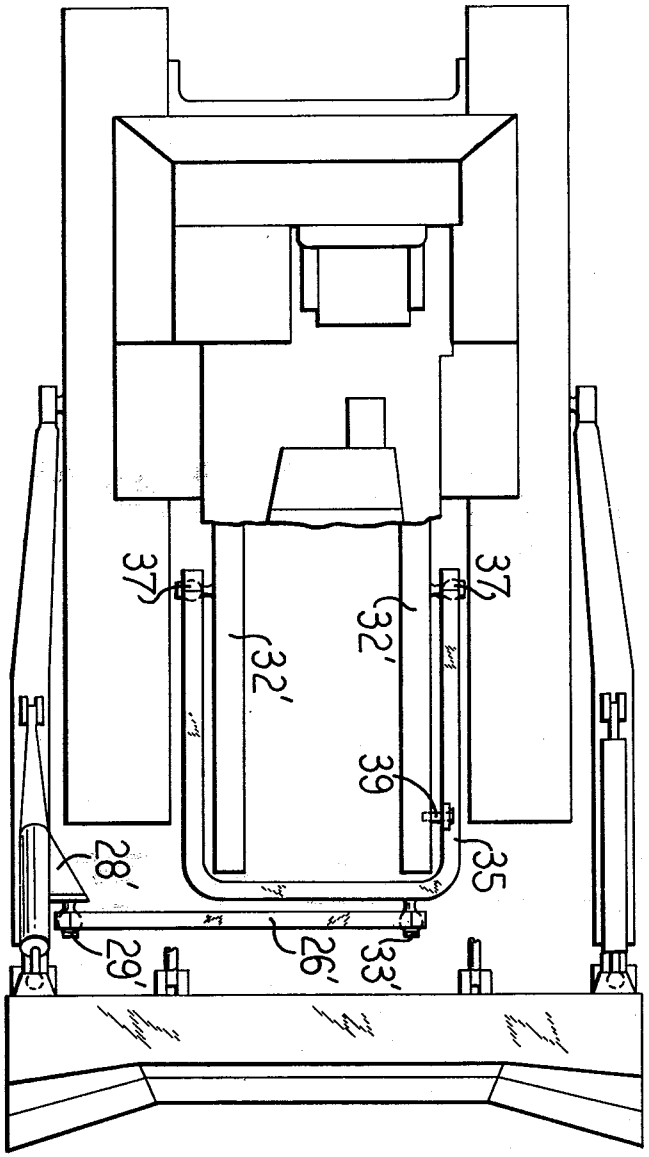
FIG. 3 is a plan view of a tractor with the engine and its housing removed, illustrating a modification of the bracing means shown in FIG. 1.

Referring to FIG. 3, a tractor identical with that shown in FIG. 1 is illustrated with the engine and engine housing removed. A C-frame auxiliary frame 35 has its free ends connected by ball and socket joints 37 to tractor main frame members 32'. The C-frame is retained against vertical swinging movement by a pin 39, loosely connecting the frame and one of the main frame members 32'. This arrangement permits slight movement of the C-frame and insures that forces are directed from link 26', connected to the C-frame by a ball and socket joint 33', to the main frame members through ball and socket joints or connections 37. Link 26', like link 26 of FIG. 1, is connected to one of the bulldozer push arms by a joint 29' and a bracket 28'.

Ball and socket joints 37 may not be necessary but they are preferred to permit slight flexing of the C-frame and cause even distribution of forces to the main frame to the rear of its forward end. Although the C-frame is shown as having its rearwardly extending arms disposed between the tractor main frame members and the tractor tracks, it is also possible to make it narrower so that its rearwardly extending arms are disposed beneath the tractor main frame members. With the construction shown in FIG. 3, link 26' moves upwardly and downwardly upon raising and lowering of the blade in the same manner as the link 26 of FIG. 1 and prevents any appreciable movement of the blade laterally of the tractor.

Figure 2:
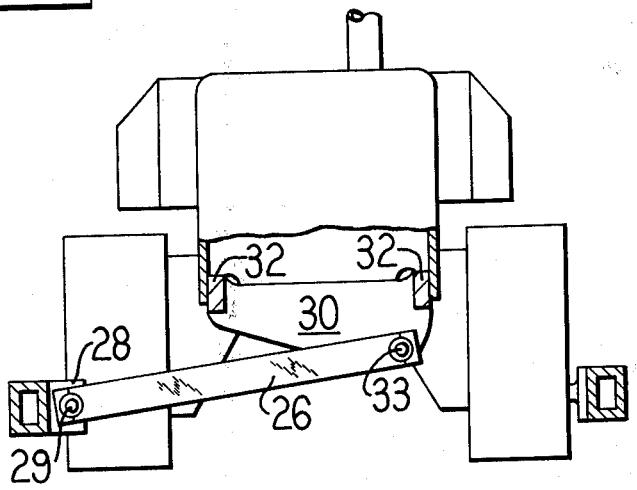
FIG. 2 is a schematic front elevation of the tractor with parts in section and with the blade removed to further illustrate the bracing means disclosed in FIG. 1.
Figure 4:
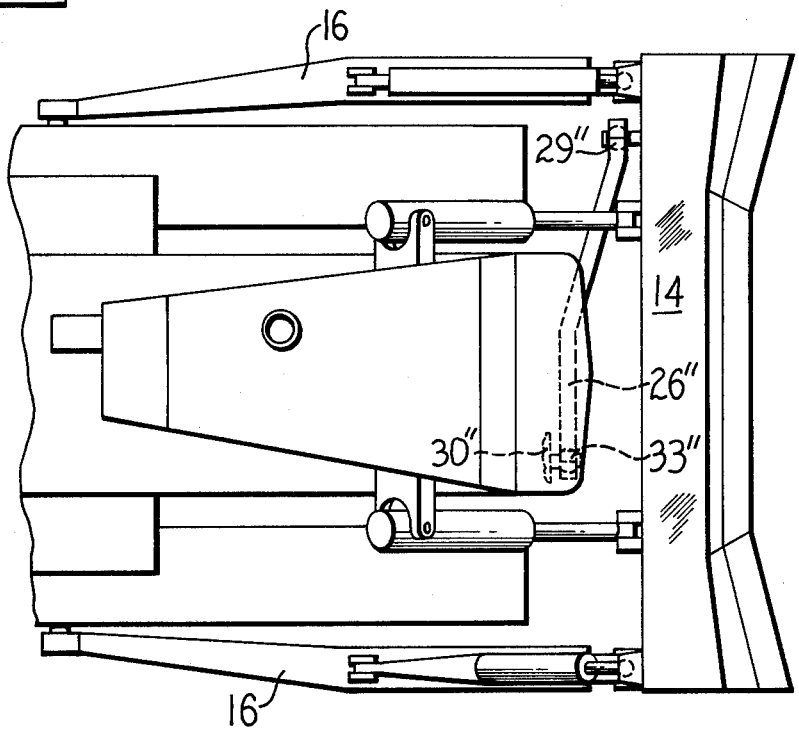
FIGS. 4 and 5 are views similar to FIGS. 1 and 2, respectively, illustrating a further modification of the bracing means shown in FIGS. 1 and 2.
Figure 5:
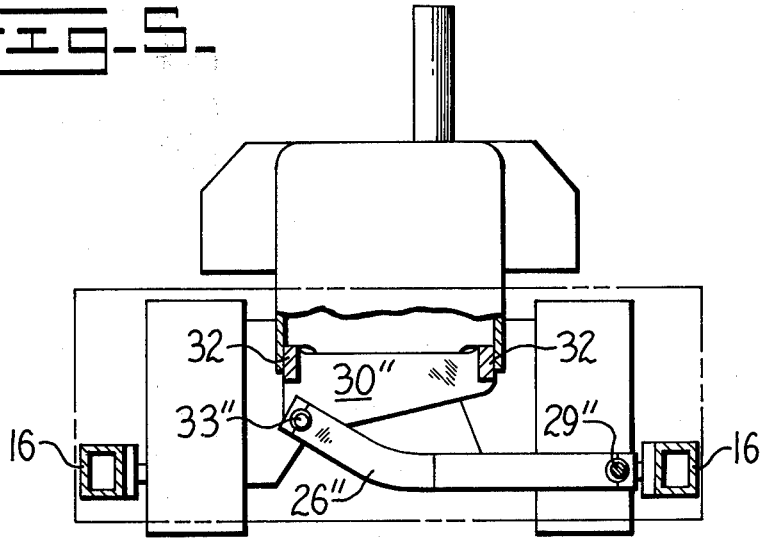

FIGS. 4 and 5 illustrate a tractor and bulldozer combination of the type shown in FIGS. 1 and 2 comprising push arms 16 having a blade 14 pivotally connected thereon. However, the corresponding bracing means or link 26'' is pivotally connected directly between the blade and tractor by ball and socket joints 29'' and 33'', respectively. The link, also disposed substantially parallel to the blade and closely adjacent thereto, is connected on a bracket 30'' secured to tractor frame members 32 at the second side of the tractor which is furthest remote from its connection with the bulldozer at the first side thereof.

Such compact arrangement, common to all of the abovedescribed three embodiments, resists the relatively high laterally imposed compressive forces normally encountered during bulldozer operations. The FIGS. 4 and 5 embodiment has the added advantages of permitting the blade to be positioned closer to the tractor and of transmitting laterally imposed compressive forces, imposed on the blade, to the tractor's main frame directly. In FIG. 1, for example, such forces will be transmitted from the blade and to the link via the blade's connection with the lower push arm 16 and connection 29 to induce bending of such push arm.

Also, the above bracing means, by permitting the blade to be positioned closely adjacent to the tractor, functions to move the center of gravity of the integrated machine rearwardly towards the center of the machine. In addition to improving the machine's stability and maneuverability, the operator's visibility is improved. As suggested above, the attachment of the first and second ends of the bracing means adjacent to one lateral end of the bulldozer and at the remote side of the tractor frame induces a very small arcuate movement of the bracing means upon raising or lowering of the blade by actuators 22.

I claim:

1. A tractor having a main frame, a bulldozer assembly comprising forwardly extending independent push arms pivotally mounted at first and second sides of said tractor and a bulldozer blade directly attached to forward ends of said push arms and positioned closely adjacent to a forward end of said tractor to extend transversely thereof, and bracing means interconnecting said main frame and said bulldozer assembly for resisting relative lateral movement therebetween consisting of a single rigid link universally connected to said frame and to said blade and located between the forward end of said tractor and said blade, said link extending transversely of said tractor and in at least substantial parallel relationship with respect to said blade.

2. The invention of claim 1 wherein said link is connected directly to the blade of said bulldozer assembly.

3. A tractor having a main frame and an auxiliary frame having ends connected to said main frame at opposite sides and rearwardly of the forward end of said main frame, forwardly extending independent push arms pivotally mounted on said tractor, a bulldozer blade directly attached to the forward ends of said push arms, and lateral brace means for said push arms and said bulldozer blade comprising means interconnecting said main frame and said blade including a link pivotally connected between said auxiliary frame and one of said push arms and positioned to extend transversely of the tractor and in substantial parallel relationship to said blade.

4. In a tractor having a main frame, forwardly extending push arms pivotally mounted on said tractor, a bulldozer blade attached to the forward ends of said push arms, lateral brace means for the push arms and bulldozer blade comprising means interconnecting said main frame and said blade, including a link pivotally interconnected between said frame and one of said push arms and extending transversely of the tractor, an auxiliary frame connected directly to said link and having ends connected to said main frame at opposite sides thereof and rearwardly of the forward end of said main frame, pivotal connections between the ends of said auxiliary frame and said main frame, and means to substantially prevent said auxiliary frame from swinging in a vertical plane about said connections.

* * * * *

UNITED STATES PATENT AND TRADEMARK OFFICE

CERTIFICATE OF CORRECTION

PATENT NO. : 3,941,195

DATED : March 2, 1976

INVENTOR(S) : ROBERT H. STEDMAN

It is certified that error appears in the above-identified patent and that said Letters Patent are hereby corrected as shown below:

Column 4, line 5, claim 2 should read:

2. The invention of claim 1 wherein a first end of said link is connected to a lateral end of said bulldozer assembly and on the first side of said tractor and wherein a second end of said link is connected to said frame on the second remote side of said tractor.

Claim 3 should read:

3. The invention of claim 1 wherein said link is connected directly to one of the push arms of said bulldozer assembly.

Renumber claim 2 as claim 4.

Claims 5-7 should read:

5. The invention of claim 1 wherein said main frame comprises an auxiliary frame mounted thereon and wherein said link is connected directly to said auxiliary frame.

6. The structure defined in claim 1 further comprising actuating means operatively connected between said tractor and said bulldozer blade for selectively raising or lowering said bulldozer blade.

7. The invention of claim 6 further comprising tilt means operatively connected between at least one of said push arms and said blade for selectively tilting said blade.

Renumber claims 3 and 4 as claims 8 and 9.

Signed and Sealed this

Thirteenth Day of July 1976

[SEAL]

*Attest:*

RUTH C. MASON
*Attesting Officer*

C. MARSHALL DANN
*Commissioner of Patents and Trademarks*